US007424755B1

(12) United States Patent
Montgomery

(10) Patent No.: US 7,424,755 B1
(45) Date of Patent: Sep. 16, 2008

(54) AESTHETIC, MULTIPURPOSE, CABINETRY ASSEMBLY FOR USE WITHIN A LAVATORY AND METHOD OF INSTALLATION

(76) Inventor: Robert D. Montgomery, 1685 W. 12th St., Reno, NV (US) 89503

( * ) Notice: Subject to any disclaimer, the term of this patent is extended or adjusted under 35 U.S.C. 154(b) by 0 days.

(21) Appl. No.: 11/891,476

(22) Filed: Aug. 10, 2007

(51) Int. Cl.
*A47K 4/00* (2006.01)
*E03C 1/01* (2006.01)

(52) U.S. Cl. ..... 4/664

(58) Field of Classification Search ..... 4/661–665, 4/428, 348; 312/228
See application file for complete search history.

(56) References Cited

U.S. PATENT DOCUMENTS 670,588 A * 3/1901 Hinsdale ..... 4/425
2,173,185 A * 9/1939 Samelow ..... 4/663
2,355,615 A * 8/1944 Helmuth ..... 4/553
2,661,481 A * 12/1953 Elsie ..... 4/420
3,412,408 A * 11/1968 Michal, Jr. ..... 4/301
3,716,872 A * 2/1973 Zieman ..... 297/188.1
D266,185 S * 9/1982 Adamcik ..... D23/274
4,944,045 A * 7/1990 Agelatos et al. ..... 4/213
5,134,728 A * 8/1992 Sturm ..... 4/307
5,694,653 A * 12/1997 Harald ..... 4/623
5,819,326 A * 10/1998 Kobayashi et al. ..... 4/252.1
6,738,989 B2 * 5/2004 Harbutt et al. ..... 4/227.1

* cited by examiner

*Primary Examiner*—Huyen Le

(57) ABSTRACT

A novel integrally molded cabinetry assembly having a commode formed therein. The commode substantially hangs inside the cabinetry and includes an outlet that is located on a first lower side portion thereof and the plumbing conduits incorporate a flexible portion. Whereby, the plumbing conduits can be installed at optional locations as they need not be installed directly above the sewer outlet as required in standard installations. The entire assembly also allows for numerous optional accessories, such as a novel sink, a special urinal, air evacuation system, a grinder, etc.

19 Claims, 5 Drawing Sheets

AESTHETIC, MULTIPURPOSE, CABINETRY ASSEMBLY FOR USE WITHIN A LAVATORY AND METHOD OF INSTALLATION

FIELD OF THE INVENTION

The invention relates in general to the construction and arrangement of fixtures normally installed and associated with lavatories. More particularly, the cabinetry assembly is sold as a kit having optional accessories dependant upon the end user's needs. The kit can be sold as a simplified version yet if additional accessories are desired the kit allows for easy addition and installation of the optional accessories after purchase. The simplified kit provides an aesthetically pleasing cabinet having an integrally formed novel shaped commode therein and the commode is supported within the cabinetry assembly. This is most advantageous as this allows for the commode to be located anywhere of choice within the lavatory. If desired additionally the kit can include a sink, a urinal and/or combinations thereof. More importantly the optional accessories include a complete odor evacuation system, a self-cleaning system, and a disposal system used for unsanitary items such as diapers, feminine products, ostomy bags, condoms, etc.

BACKGROUND OF THE INVENTION

As of to date the general fixtures associated with a typical lavatory include a commode, a sink, a shower/bathtub, a mirror, and storage cabinets. Many variations of all of the fixtures accept the commode have been proposed and resolved so as to provide a more appealing appearance. As a result most lavatories available today include beautiful cabinets, shower/tubs, sinks, and mirrors. However, the standard commode has not yet been aesthetically altered and thus the commode tends to be the most unappealing fixture within the lavatory. Also, due to the standard design commodes are very difficult to keep clean and can become a true eyesore. One of the main disadvantages with the standard commode is the fact that it must be installed onto a wax-ring mounted directly over the sewer outlet pipe. This type of wax-ring mounting causes numerous problems. For example, the wax-ring over time deforms and/or sinks and this causes not only leakage but also the commode tends to tilt and become unstable. Furthermore, the wax-ring mounting causes a crevasse between the commode and the wax-ring and the crevasse tends to accumulate unsightly grime that is difficult to remove and can also become unsanitary. As a result it is clearly apparent that the standard commode and its interconnection onto the sewer outlet pipe needs to be modified not only to improve function but also to be aesthetically pleasing.

In the past numerous attempts have been proposed to either conceal the standard commode and/or modify it in a manner that is more appealing. However, each attempt or suggested modification have numerous inherent disadvantages, all of which the present invention recognizes, addresses and resolves in a new and novel manner heretofore not taught.

Within the known prior art most suggested or proposed concepts include no modification to the actual commode but simply teach a means for concealing the standard commode within an outer cabinet structure or the like. For reference note U.S. Pat. Nos. D454,185, 2,749,068 and the most recent 7,174,578. Each of which resolve the aesthetic issue by simply installing substantially an exterior seat so as to enclose and conceal the standard commode therein. Also, for convenience the exterior seat assembly may include shelves and/or compartments for storage of articles associated with the commode, such as toilet paper, cleaning supplies, etc.

Still further known prior art includes U.S. Pat. No. 6,311,341 which teaches a chair having a covering for the commode, the tank, the hinged seat, the bowl and the flushing handle. Further provided the chair includes arm rests and a foot pedal assembly operably connected to the hinged seat cover for positioning the seat cover between an open and closed position.

All of the known prior art simply provide an exterior structure for camouflaging and containment of the typical commode having the standard water closet therein. None of the cited references recognize the problems associated with the standard commode/water-closet other than its unsightly appearance. Thus, the problems associated with the standard commode/water-closet mounted onto a wax-ring have not been resolved nor even recognized heretofore.

OBJECTS AND ADVANTAGES OF THE PRESENT INVENTION

It is therefore a primary object of the present invention to provide a new and novel type of cabinetry assembly with the commode that is integrally formed from an aesthetically pleasing material, preferably from marble, or the like.

Another object of the present invention is to provide a new and novel type of commode that includes an optional water-closet arrangement that is much more functional and most aesthetically pleasing.

A further important object of the present invention is to provide a new and novel type of commode/water-closet that eliminates the weight of the commode being transferred onto the standard wax-ring mounting system.

Another object of the present invention is to provide a commode and cabinetry assembly that can be installed anywhere of choice within the lavatory. Traditionally, all commodes must be installed directly above the sewer outlet pipe. The present commode provides a new type of sewer pipe attachment means that is flexible and also can be variable in length.

Yet a further object of the present invention is to provide a new and novel type of commode wherein the bowl itself is integrally molded into the top section of the cabinetry assembly. The molded bowl protrudes slightly outward from the cabinetry assembly so as to be ergonomically correct to allow a user to comfortably sit with their feet, legs, thighs and buttocks in the preferred position of choice.

Also a further object of the present invention is to provide a commode that is universal and allows various users of different sizes to comfortably position themselves thereon.

Yet a very import object of the present invention is to provide a commode that is foot operated by a pedal so as to provide complete hands-free operation. This is not only for convenience but more importantly eliminates exposure to germs distributed onto and associated with standard flush handles.

Still a further object of the present invention is to provide a commode and cabinet assembly that can be installed in smaller lavatories due to the position of the side orientated water closet associated with the commode.

Yet a further object of the present invention is to provide a commode that can be constructed and installed using standard plumbing connectors, hoses and water traps so that no specialized equipment need be manufactured or purchased.

A further object of the present invention is to provide a commode that conserves water and improves flush operation.

A very important object of the present invention is to provide a cabinetry assembly that encloses all of the pipes, water lines, etc, yet also allows for easy access via cabinet doors.

Still another important object of the present invention is to provide various plumbing features that allow for repair, cleaning, modifications, addition of optional accessories and the like.

A further object is to provide a cabinetry assembly that includes an optional novel type of sink. The sink includes a washbasin that allows for washing of the face or the like but further provides a partially enclosed hand washing area. Also, if preferred the sink allows for objects, such as a toothbrush to be cleansed within the hand washing area. The enclosed hand washing area is most convenient and eliminates splashing of which simplifies cleanup.

Yet another object of the present invention is to provide a cabinetry assembly with commode that is economical to produce, sell, easy to install and allows for numerous multipurpose options to be easily incorporated.

Other objects and advantages will be seen when taken into consideration with the following specification and drawings.

DETAILED DESCRIPTION OF THE DRAWINGS

Figure 1:
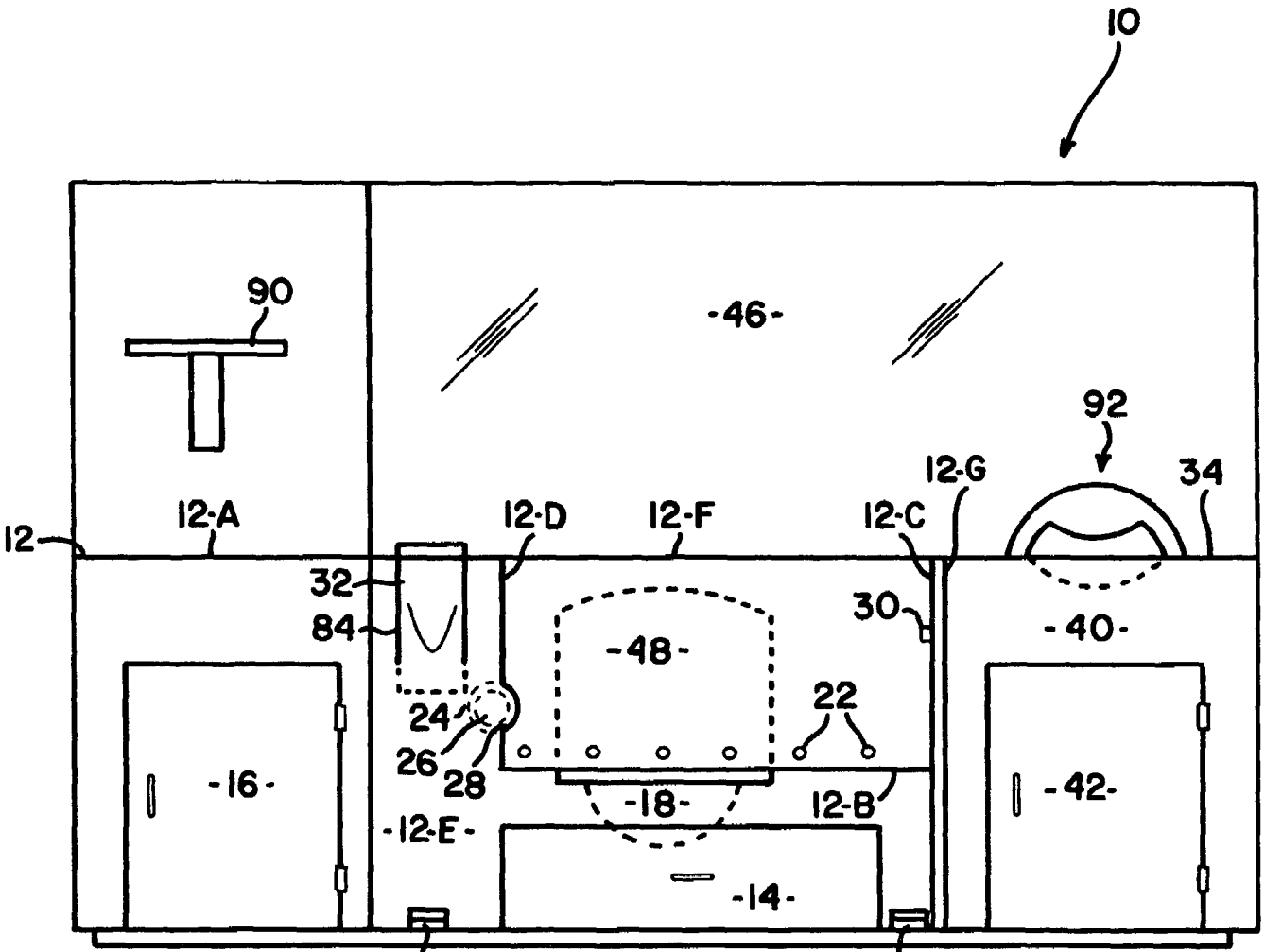
FIG. 1 is substantially a front view of my aesthetic cabinetry assembly.

Referring now in detail to the drawings wherein like characters refer to like elements throughout the various views. FIG. 1 substantially represents the preferred embodiment for the present invention. However, it is to be noted the invention as depicted herein is only exemplary of one possible configuration as many variables and optional combinations are possible. Thus the invention is not to be limited and all the features are of engineering choice. As illustrated in FIG. 1, (10) represents a general overview for the present invention of which is an aesthetic, multipurpose, cabinetry assembly. The entire assembly can be integrally molded from marble material or the like or it can be manufactured and assembled as independent components depending on the needs of the end user. The basic components for the invention include an elongated integrally formed horizontal countertop (12) having a first horizontal section (12-A), a second horizontal section (12-B), a right side vertical panel (12-C), a left side vertical panel (12-D), a front vertical panel (12-E) and a rear vertical panel (12-F). The first horizontal section (12-A) with the left side vertical panel (12-D), the rear vertical panel (12-F) and the front vertical panel (12-E) in combination form a first cabinet assembly. The front vertical panel (12-E) having a first cabinet access door (14) and a second access door (16). The second horizontal section (12-B) having an integrally molded commode seat area formed in between a vertical right side wall of right side vertical panel (12-C), a rear wall of rear vertical panel (12-F) and a vertical left side wall of left side vertical panel (12-F). The integrally molded commode seat area having an integrally molded commode bowl (18) therein of which includes a first commode bowl outlet (20) (shown in FIG. 2) that is substantially located on a first lower side portion thereof. Also, the integrally molded commode seat area further includes air evacuation holes (22) for completely evacuating any foul odors from the surrounding area. Still further the integrally molded commode seat area also includes an integrally molded recess (24) for containment of a toilet paper roll (26) and the recess (24) includes closure means (28). It is to be noted any suitable type of closure means of engineering choice may be incorporated, such as a sliding retractable cover or the like. The integrally molded commode seat area further includes a manual flush mechanism (30), of which is also of engineering choice such as a push-button or the like.

Further depicted in FIGS. 1-4, the front vertical panel (12-E) also includes as an optional feature an integrally formed urinal (32) thereon. The urinal is most advantageous as this encourages male users to use the urinal instead of the commode. Men have a tendency to occasionally splash or misdirect the urine stream of which can be bothersome and quite messy. Whereby, users of the commode find this most troublesome and unsanitary. Therefore, the urinal is much more appropriate for male users and also the present urinal includes additional features (later described).

Figure 2:
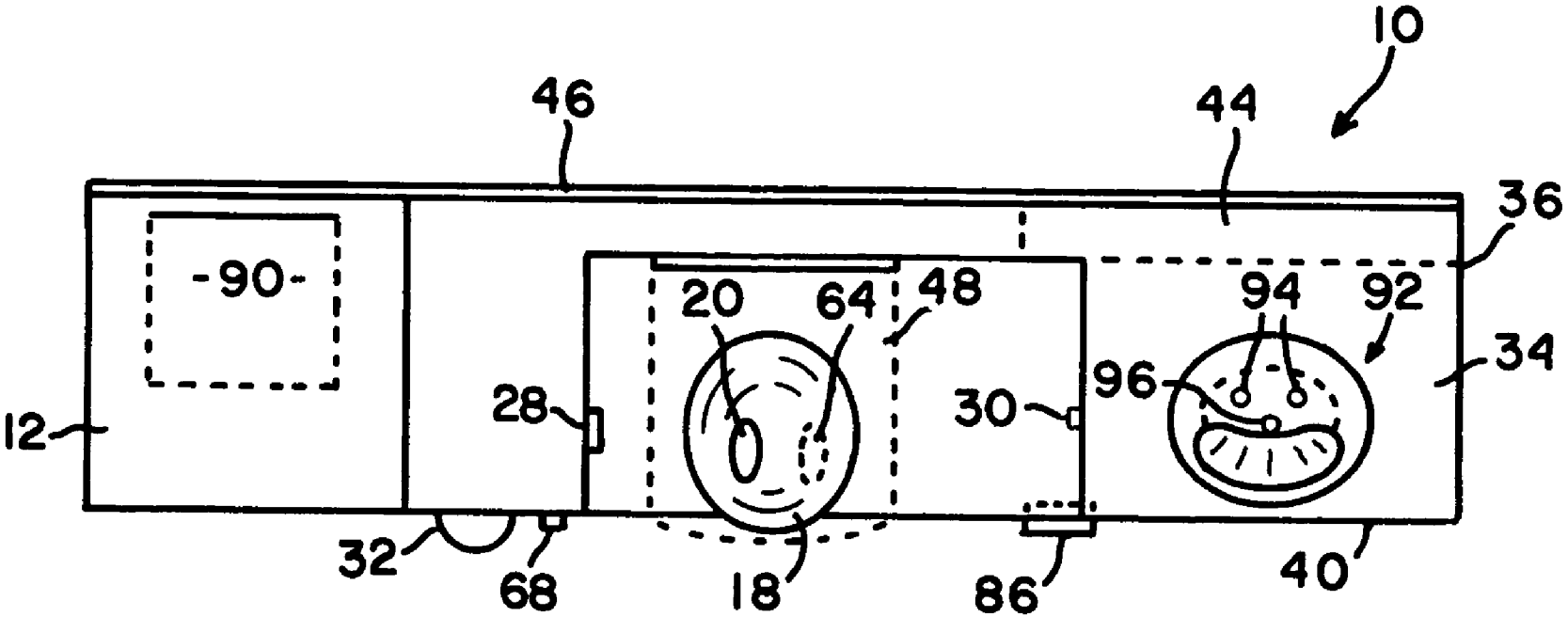
FIG. 2 is substantially a front view of my aesthetic cabinetry assembly.

Further depicted in FIGS. 1 & 2, the cabinet assembly (10) includes as an option a third horizontal section (34) integrally molded onto the vertical right side wall (12-G) of the vertical right side panel (12-C). The right side vertical panel is attachable onto the third horizontal section (34) by any suitable attachment means, and the third horizontal section (34) with a rear vertical panel (36) (see FIG. 2), with a second right side vertical panel (40) and front vertical panel (40) in combination form a second cabinet of which also includes a third access door (see FIG. 1). As can be seen, the cabinetry assembly can be installed as one unit having the commode area and one cabinet or multiple cabinet(s) can be installed depending on the needs of the end user.

It is to be noted for aesthetic purposes, the cabinetry assembly may also include other features such as a mirror (46) or the like. Also, the commode bowl (18) can be recessed within the commode bowl area of which allows for a flush installation. This is most advantageous as the commode bowl can be concealed and located below a commode bowl lid (48). The lid (48) can be raised for use into an open position (shown in ghost lines) and when not in use lowered. Whereby, the overall aesthetic appearance of the entire assembly resembles a couch, respectively when the commode bowl lid is in the lowered position.

As previously noted, the present invention includes a non-standard water tank (44) for flushing and filling the integrally molded commode bowl that is "not" positioned behind the commode, (see FIG. 2). This is very important as this greatly decreases the required amount of space when compared to the typical installation requirements associated with standard water closets. It is to be understood the internal workings of the water tank (44) are not taught herein as the shape and location are novel but the internal components are well known within the prior art.

One of the important novel features of the present commode bowl installation is that it can be installed at any location of user choice. For example, any standard commode bowl must be installed directly above the sewer outlet pipe. This is most restricting and does not allow for remodeling and relocating of the commode without complicated costly modifications. Therefore, to resolve this problem the present invention has eliminated the standard above sewer outlet installation and includes a new plumbing conduit alternative. Whereby, the end result allows the commode bowl to hang from the cabinetry as opposed to sitting on a floor support structure. Thus, the following is a general description of some of the plumbing alternatives associated with the present commode bowl installation method. Namely, the first commode bowl outlet (20) is removably interconnected onto a commode bowl outlet pipe and the commode bowl outlet pipe (hereafter defined) is in open communication and removably interconnected onto a sewer outlet pipe via plumbing conduits.

Figure 5:
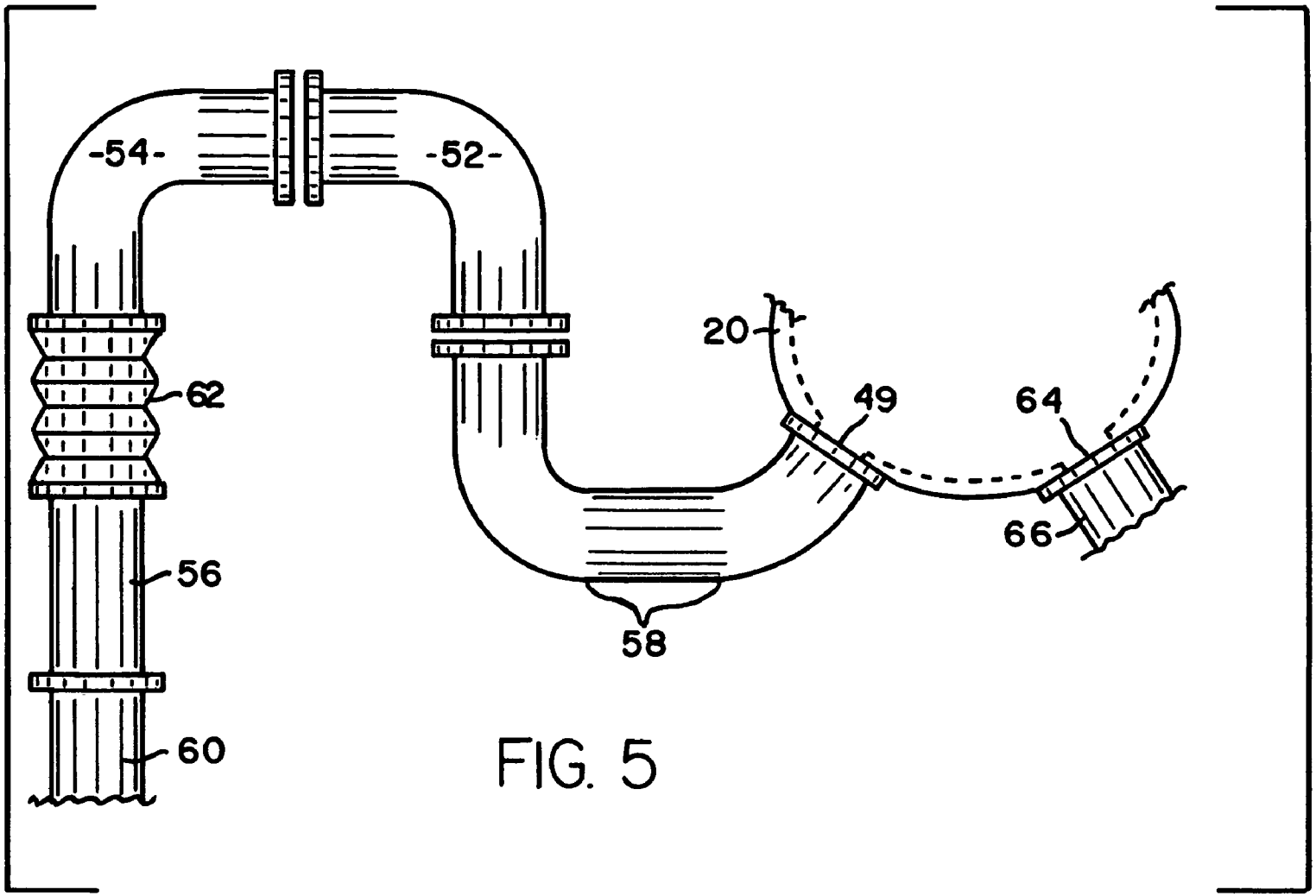
FIG. 5 is substantially an overview depicting one embodiment for plumbing conduits.

In reference to FIG. 5, the plumbing conduits include a first connector conduit (50), a second connector conduit (52), a third connector conduit (54) and a fourth connector conduit (56). Each connector conduit (50, 52, 54, & 56) in combination form a water trap. The first connector conduit (50) has a first end removably interconnected onto commode bowl outlet pipe (49) and a second end removably interconnected onto the second connector conduit (52). The first connector conduit (50) has a horizontal flat bottom section (58). The flat bottom section includes a removable plate (not shown) of which when removed can be used to install the grinder into the system if so desired. The second connector conduit (52) has a first end removably interconnected onto the second end of the first connector conduit (50) and a second end removably interconnected onto a first end of the third connector conduit (54). The third connector conduit (54) has a second end removably interconnected onto a first end of the fourth connector conduit (56) and the fourth connector conduit (56) has a second end removably interconnected onto the sewer outlet pipe (60). It is to be noted any suitable type of attachment means of engineering choice may be incorporated for removably interconnecting each of the conduits, as numerous types of attachment means are available.

As previously noted, the cabinet assembly houses a water tank (44) for flushing and filling the integrally molded commode bowl (18) and the integrally molded commode seat area further includes a manual flush mechanism (30) having a first flush mode. In operation it can now be seen that the water tank (44) with the flush mechanism (30) with the plumbing conduits (49, 50, 52, 54 & 56) in combination allow waste material within the commode bowl (18) to be evacuated and forcibly directed into the sewer outlet pipe (60) and directed outwardly there from. Further depicted in FIG. 5 at least one (or multiples) of the plumbing conduits (49, 50, 52, 54 & 56) have a middle section wherein a flexible hose (62) is installed. Whereby the plumbing conduits need not be installed in direct vertical alignment with the sewer outlet pipe (60) as the flexible hose (62) allows for variable flexible installation adjustment.

As previously noted numerous optional features are to be included within the present invention. For example, if the end user wishes to include a grinder for disposal of specific waste products, such as a diaper, condom, ostomy products, etc, then the following additional features are to be included. Wherein, the integrally molded commode bowl (18) further includes a second commode bowl outlet (64) located on a second lower side portion thereof (only shown in FIG. 1). The first commode bowl outlet (20) has closure means (not shown) and the second commode bowl outlet has closure means (not shown). The second commode bowl outlet (64) is removably interconnected onto a first end of a fifth connector conduit (66) by any suitable attachment means and a second end removably interconnected onto a first end of a grinder apparatus. It is to be noted any type of grinder apparatus may be incorporated thus the grinder is only represented in block diagram FIG. 6. The grinder apparatus has second end removably interconnected onto the sewer outlet pipe (60). The flush mechanism (30) further includes a second flush mode and the second flush mode when actuated automatically closes the closure means of the first commode bowl outlet (20) and opens the closure means of the second commode bowl outlet (64). Whereby any waste material contained within the integrally molded commode bowl (18) is forcibly directed outwardly there from into the grinder apparatus. Thereafter, the grinder apparatus pulverizes the waste material into minute particles and the minute particles are then forcibly directed outwardly there from into said sewer outlet pipe (60).

As previously noted the integrally molded commode seat area has air evacuation holes (22) and a foul air evacuation system for evacuating foul air via the air evacuation holes. Again, any suitable type of air evacuation system may be incorporated and thus is only represented in block diagram FIG. 6. If the air evacuation system is included then the flush mechanism (30) further includes a third flush mode and the third flush mode when actuated automatically actuates the foul air evacuation system.

Another alternative for the present invention is to include within the water tank (44) a cleaning solution and when said flush mechanism is actuated the commode (18) is automatically cleansed by the cleaning solution (not shown).

Figure 3:
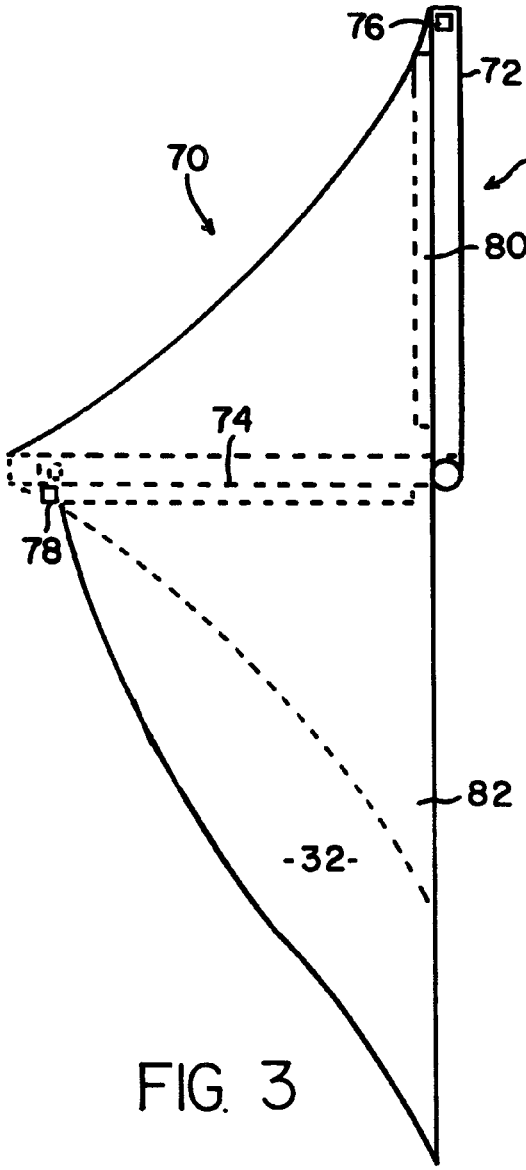
FIG. 3 is substantially a side view depicting a urinal.
Figure 4:
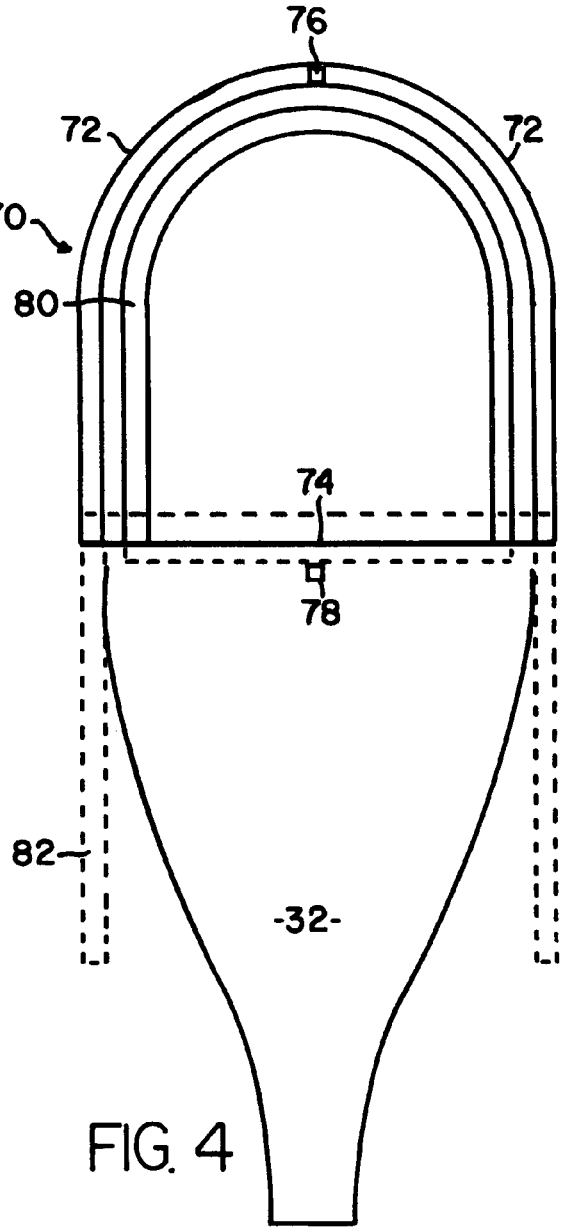
FIG. 4 is substantially a front view of FIG. 3.
Figure 6:
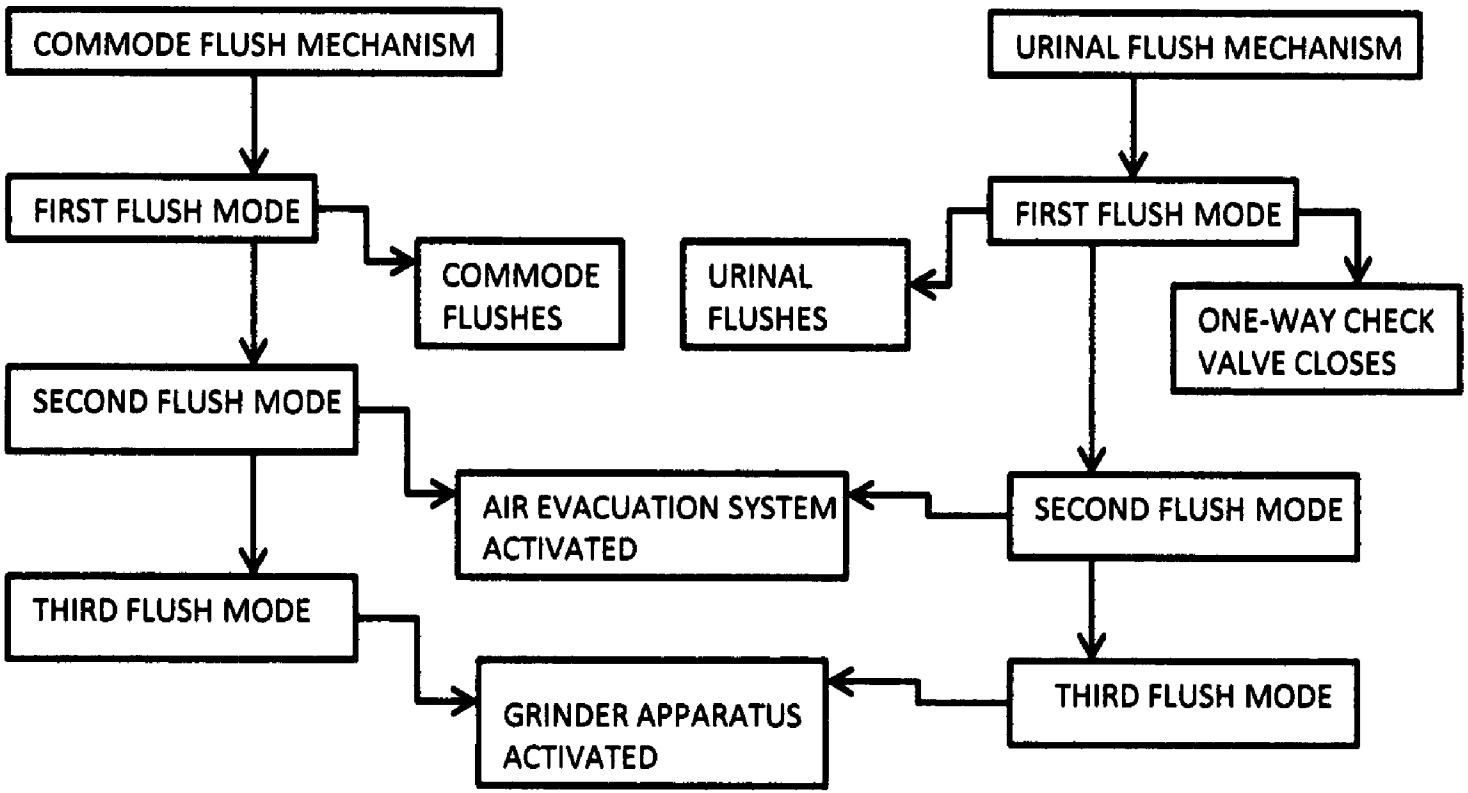
FIG. 6 is substantially a block diagram representing various optional components for the present invention.

Referring now in more detail to the urinal and the optional features associated therewith. As represented in FIGS. 3, 4 & 6 the urinal (32) urinal is in communication with the water tank. It is to be understood the actual conduits and/or plumbing attachments are not taught as such is very well known within the prior art. The urinal (32) has a second flush mechanism (68) having a first flush mode. The urinal (32) is interconnected with the existing plumbing conduits via an additional conduit assembly (not shown) and at least one of the plumbing conduits further include a one-way check valve (not shown). Whereby when the second flush mechanism (68) is actuated into the first flush mode, the one-way check valve is automatically closed and the water tank with the urinal with the additional conduit assembly in combination forcibly direct waste material from within the urinal (32) into the sewer outlet pipe (60) and outwardly there from.

Yet another optional feature for the urinal (32) is to include within the additional conduit assembly the grinder system. Wherein the second flush mechanism (68) includes a second flush mode and a third flush mode. Whereby when the second flush mechanism is actuated into the second flush mode, the one-way check valve is automatically closed and the water tank (44) with the urinal (32) with the additional conduit assembly in combination forcibly direct waste material from within the urinal (32) into the grinder. Thereafter, the grinder pulverizes the waste material into minute particles and the minute particles are then forcibly directed into said sewer outlet pipe (60) and outwardly there from. As previously noted, the water tank (44) further contains a cleaning solution and when the second flush mechanism (68) is actuated into the first flush mode, the urinal and the closure means (hereafter described) are automatically cleansed by the cleaning solution.

Referring now in detail to FIGS. 3 & 4, wherein the optional features for the urinal are more clearly defined. Namely, the urinal (32) includes closure means of engineering choice. However the preferred closure means (70) as taught herein has novel advantages of which will be seen. For example, the closure means (70) includes a cap (72) hingedly attached onto the urinal opening (74). The cap (72) includes an open position and a closed position (the closed position illustrated in ghost lines). The cap (72) has a sensor (76) and the urinal has a sensor (78). Whereby, when the cap assumes the closed position the flush mechanism is automatically actuated and flushes the urinal and the inside of the cap. When the cap (72) assumes the open position, the air evacuation system is automatically actuated and removes any foul air and/or gases from the surrounding area. More importantly the cap also includes side panels (82) of which function as splash-guards. This is most convenient and helps to eliminate accidental messes. As can be seen in FIG. 4, the cap is constructed with a downwardly protruding gasket (80) and when the cap (72) is closed onto the urinal the gasket provides a secure leak-free fit. Another feature for the urinal is to include adjustment means (not shown) of which allows a user to slidably vertically adjust the height of the urinal into a position of choice. The adjustment means is of engineering choice as many suitable types of adjustment means exist within the prior art. However, for an example FIG. 1 depicts slide rails (84) of which are most functional.

It is to be understood that the flush modes can be independent or combined depending on the needs of the end user. Also, if desired each of the flush mechanisms can be operated via foot pedals (86 & 88). This is most advantageous as this allows for complete hands-free operation resulting in less bacterial contamination associated with hand operated levers.

Yet another optional feature for the present invention is to provide a baby changing station, such as on the top surface of the cabinetry assembly (12-A). The baby changing station is most convenient and also includes air evacuation means (90) for removing foul air within the surrounding area. The air evacuation means (90) can be any suitable type of engineering choice. However, a most functional system is taught within my U.S. Pat. No. 7,094,266 and can easily be incorporated for use within the present invention. For further convenience, the air evacuation means (90) can be pivotably mounted and retracted onto the wall when not in use. The baby changing station is most novel as the flat surface area is not only functional for support of a baby thereon, but this further allows a user to easily remove a soiled diaper from the baby and discard the soiled diaper into the commode bowl or urinal and actuate the flush mechanism into the flush mode operable for the grinder. Nowhere in the prior art known to the applicant is there a functional commode and/or urinal that can actually pulverize the soiled diaper and dispose of it via the sewer system in an environmentally friendly manner.

The aesthetic, multipurpose, cabinetry assembly with an integrally molded commode for use within a lavatory may further include on the third horizontal section an integrally molded sink (92) that is formed from a lower washbasin and an upper shield in combination. The said upper shield in the preferred embodiment includes internal spray nozzles of which are activated by a motion sensor. Also, a soap dispenser system may be easily incorporated. The spray nozzles and/or sensors are not taught herein as they are very well known in the art. However, it is to be understood that other control means may be incorporated such as hot and cold faucets (94) and/or a specialized water fixture (96) that is used for cleaning a toothbrush or any other object of user choice. Also another feature is that the upper shield is transparent and this allows a user to easily view their hands/objects while washing.

It is to be noted that certain components, such as the commode bowl itself and/or the sink may be purchased independently and installation would only require a snap-in fit or the like.

It can now be seen I have herein provided a new and novel type of aesthetic, multipurpose, cabinetry assembly with integrally formed commode, urinal, sink, baby-changing area, air evacuation system and disposal means of which heretofore has not been taught.

Although the invention has been herein shown and described in what is conceived to be the most practical and preferred embodiment, it is recognized that departures may be made there from within the scope and spirit of the invention, which is not to be limited to the details disclosed herein but is to be accorded the full scope of the claims so as to embrace any and all equivalent devices and apparatuses.

Having described the invention, what I claim as new and desire to secure by Letters Patent is:

1. An aesthetic, multipurpose, cabinetry assembly with an integrally molded commode for use within a lavatory comprising: an elongated integrally formed horizontal countertop having a first horizontal section; a second horizontal section; a right side vertical panel; a left side vertical panel; a front vertical panel and a rear vertical panel; said first horizontal section with said left side vertical panel with said rear vertical panel and said front vertical panel in combination form a first cabinet, said front vertical panel having a first cabinet access door, said front vertical panel having a second access door, said second horizontal section having an integrally molded commode seat area formed in between a vertical right side wall, a rear wall and a vertical left side wall, said integrally molded commode seat area having an integrally molded commode bowl therein, said integrally molded commode bowl having a first commode bowl outlet located on a first lower side portion thereof said first commode bowl outlet is removably interconnected onto a commode bowl outlet pipe, said commode bowl outlet pipe being in open communication and removably interconnected onto a sewer outlet pipe via plumbing conduits said plumbing conduits comprising; a first connector conduit, a second connector conduit; a third connector conduit; and a fourth connector conduit: each said conduit in combination form a water trap, said first connector conduit having a first end removable interconnected onto said commode bowl outlet pine and a second end removably interconnected onto said second connector conduit, said first connector conduit having a horizontal flat bottom section, said second connector conduit having a first end removably interconnected onto said second end of said first connector conduit and a second end removably interconnected onto a first end of said third connector conduit, said third connector conduit having a second end removably interconnected onto a first end of said fourth connector conduit, said fourth connector conduit having a second end removably interconnected onto said sewer outlet pipe, said cabinet assembly houses a water tank for flushing and filling said integrally molded commode bowl, said integrally molded commode seat area further includes a manual flush mechanism having a first flush mode, said water tank with said flush mechanism with said plumbing conduits in combination allow waste material within said commode bowl to be evacuated and forcibly directed into said sewer outlet pipe then directed outwardly there from, said integrally molded commode seat area having air evacuation holes and a foul air evacuation system for evacuating foul air via said air evacuation holes.

2. The aesthetic, multipurpose, cabinetry assembly with an integrally molded commode for use within a lavatory of claim 1 wherein said integrally molded commode seat area further includes an integrally molded recess for containment of a toilet paper roll and said recess includes closure means.

3. The aesthetic, multipurpose, cabinetry assembly with an integrally molded commode for use within a lavatory of claim 1 wherein said front vertical panel further includes an integrally formed urinal thereon.

4. The aesthetic, multipurpose, cabinetry assembly with an integrally molded commode for use within a lavatory of claim 3 wherein said integrally formed urinal further includes closure means.

5. The aesthetic, multipurpose, cabinetry assembly with an integrally molded commode for use within a lavatory of claim 1 further includes a third horizontal section integrally molded onto said vertical right side wall, said right side vertical panel is attachable onto said third horizontal section, said third horizontal section with said rear vertical panel with said right side vertical panel and said front vertical panel in combination form a second cabinet and said front vertical panel having a third access door.

6. The aesthetic, multipurpose, cabinetry assembly with an integrally molded commode for use within a lavatory of claim 1 further includes at least one of said plumbing conduits having a middle section, said middle section being a flexible hose, whereby said plumbing conduits need not be installed in direct vertical alignment with said sewer outlet pipe as said flexible hose allows for variable installation adjustment.

7. The aesthetic, multipurpose, cabinetry assembly with an integrally molded commode for use within a lavatory of claim 1 further includes said flush mechanism having a third flush mode and said third flush mode when actuated automatically actuates said foul air evacuation system.

8. The aesthetic, multipurpose, cabinetry assembly with an integrally molded commode for use within a lavatory of claim 1 wherein said water tank further contains a cleaning solution and when said flush mechanism is actuated, said commode is automatically cleansed by said cleaning solution.

9. The aesthetic, multipurpose, cabinetry assembly with an integrally molded commode for use within a lavatory of claim 1 wherein said cabinetry assembly further includes a flat surface area located on said first horizontal section, said flat surface area is functional for support of a baby thereon, whereby a user can easily remove a soiled diaper from said baby and discard said soiled diaper into said commode bowl and actuate said flush mechanism into said third flush mode.

10. The aesthetic, multipurpose, cabinetry assembly with an integrally molded commode for use within a lavatory of claim 1 wherein said cabinetry assembly further includes an integrally molded sink formed from a lower wash basin and an upper shield in combination and said upper shield having internal spray nozzles of which are activated by a motion sensor.

11. The aesthetic, multipurpose, cabinetry assembly with an integrally molded commode for use within a lavatory of claim 10 wherein said upper shield further includes a specialized water fixture that is specifically used for washing an item, such as a toothbrush.

12. The aesthetic, multipurpose, cabinetry assembly with an integrally molded commode for use within a lavatory of claim 10 wherein said upper shield is transparent.

13. The aesthetic, multipurpose, cabinetry assembly with an integrally molded commode for use within a lavatory of claim 10 wherein said upper shield further includes a soap dispensing system.

14. An aesthetic, multipurpose, cabinetry assembly with an integrally molded commode for use within a lavatory comprising: an elongated integrally formed horizontal countertop having a first horizontal section; a second horizontal section; a right side vertical panel; a left side vertical panel; a front vertical panel and a rear vertical panel; said first horizontal section with said left side vertical panel with said rear vertical panel and said front vertical panel in combination form a first cabinet, said front vertical panel having a first cabinet access door, said front vertical panel having a second access door, said second horizontal section having an integrally molded commode seat area formed in between a vertical right side wall, a rear wall and a vertical left side wall, said integrally molded commode seat area having an integrally molded commode bowl therein, said integrally molded commode bowl having a first commode bowl outlet located on a first lower side portion thereof, said cabinetry assembly housing a water tank, said cabinetry assembly having a flush mechanism, said integrally formed horizontal countertop having an integrally formed urinal, said first commode bowl outlet is removably interconnected onto a commode bowl outlet pipe, said commode bowl outlet pipe being in open communication and removably interconnected onto a sewer outlet pipe via plumbing conduits, said plumbing conduits comprising: a first connector conduit, a second connector conduit; a third connector conduit; and a fourth connector conduit; each said conduit in combination form a water trap, said first connector conduit having a first end removably interconnected onto said commode bowl outlet pipe and a second end removably interconnected onto said second connector conduit, said first connector conduit having a horizontal flat bottom section, said second connector conduit having a first end removably interconnected onto said second end of said first connector conduit and a second end removably interconnected onto a first end of said third connector conduit, said third connector conduit having a second end removably interconnected onto a first end of said fourth connector conduit, said fourth connector conduit having a second end removably interconnected onto said sewer outlet pipe, said first cabinet houses a water tank for flushing and filling said integrally molded commode bowl, said flush mechanism having a first flush mode, said water tank with said flush mechanism with said plumbing conduits in combination allow waste material within said commode bowl to be evacuated and forcibly directed into said sewer outlet pipe then directed outwardly there from, said urinal being in communication with said water tank, said urinal having a second flush mechanism having a first flush mode, said urinal being interconnected with said plumbing conduits via an additional conduit assembly, at least one of said plumbing conduits having a one-way check valve, whereby when said second flush mechanism is actuated into said first flush mode, said one-way check valve is automatically closed and said water tank with said urinal with said additional conduit assembly forcibly direct waste material from within said urinal into said sewer outlet pipe and outwardly there from.

15. The aesthetic, multipurpose, cabinetry assembly with an integrally molded commode for use within a lavatory of claim 14 wherein said additional conduit assembly further includes a grinder system, said second flush mechanism includes a second flush mode, whereby when said second flush mechanism is actuated into said second flush mode, said one-way check valve is automatically closed and said water tank with said urinal with said additional conduit assembly forcibly direct waste material from within said urinal into said grinder, said grinder pulverizes said waste material into minute particles and said minute particles are then forcibly directed into said sewer outlet pipe and outwardly there from.

16. The aesthetic, multipurpose, cabinetry assembly with an integrally molded commode for use within a lavatory of claim 14 wherein said urinal further includes a closure means, said water tank further contains a cleaning solution and when said second flush mechanism is actuated into said first flush mode, said urinal and said closure means are automatically cleansed by said cleaning solution.

17. The aesthetic, multipurpose, cabinetry assembly with an integrally molded commode for use within a lavatory of claim 14 wherein said flush mechanism is a foot-pedal.

18. The aesthetic, multipurpose, cabinetry assembly with an integrally molded commode for use within a lavatory of claim 14 wherein said second flush mechanism is a foot-pedal.

19. The aesthetic, multipurpose, cabinetry assembly with an integrally molded commode for use within a lavatory of claim 14 wherein said second flush mechanism further includes a third flush mode, said urinal further includes air evacuation holes and a foul air evacuation system, and when said second flush mechanism is actuated into said third flush mode, said urinal, said grinder system and said foul air evacuation system are simultaneously activated.

* * * * *